US009301651B2

(12) United States Patent
Magone

(10) Patent No.: US 9,301,651 B2
(45) Date of Patent: Apr. 5, 2016

(54) PIVOTABLE SHELF FOR A BATHTUB

(71) Applicant: Ella's Bubbles, LLC, Chicago, IL (US)

(72) Inventor: Laimonis Magone, Chicago, IL (US)

(73) Assignee: Ella's Bubbles, LLC, Chicago, IL (US)

( * ) Notice: Subject to any disclaimer, the term of this patent is extended or adjusted under 35 U.S.C. 154(b) by 253 days.

(21) Appl. No.: 13/920,816

(22) Filed: Jun. 18, 2013

(65) Prior Publication Data

US 2013/0333108 A1 Dec. 19, 2013

Related U.S. Application Data

(60) Provisional application No. 61/661,009, filed on Jun. 18, 2012.

(51) Int. Cl.
*A47K 3/00* (2006.01)

(52) U.S. Cl.
CPC ..... *A47K 3/001* (2013.01); *A47K 3/004* (2013.01)

(58) Field of Classification Search
CPC ..... A47K 3/001; A47K 3/004; A47K 3/122
USPC ..... 4/559, 548, 551
See application file for complete search history.

(56) References Cited

U.S. PATENT DOCUMENTS

| | | | | |
|---|---|---|---|---|
| 345,918 | A * | 7/1886 | Palmer | 4/559 |
| 578,374 | A * | 3/1897 | Trull | 4/644 |
| 3,449,773 | A * | 6/1969 | Seib | A47K 3/004 4/549 |
| 4,628,550 | A * | 12/1986 | Walton | 4/560.1 |
| 5,150,482 | A * | 9/1992 | Shapiro | 4/562.1 |
| 6,065,251 | A * | 5/2000 | Kindrick | 52/36.4 |
| 7,284,735 | B1 * | 10/2007 | Khosropour et al. | 248/226.11 |
| 7,461,417 | B2 * | 12/2008 | Godbersen | 4/541.1 |
| 2002/0020797 | A1 * | 2/2002 | Artz | 248/424 |
| 2011/0099787 | A1 * | 5/2011 | Stafford | A47K 3/001 29/428 |

* cited by examiner

*Primary Examiner* — J. Casimer Jacyna
(74) *Attorney, Agent, or Firm* — Olson & Cepuritis, Ltd.

(57) ABSTRACT

A bathtub assembly includes a tub body and a positionable shelf including a substantially planar platform and a mounting post disposed in a corner portion of the platform. A mount for the positionable shelf defines a socket for the mounting post and includes a flanged, outwardly threaded, hollow tubular portion open at both ends and a flanged sleeve therewithin. The mounting post can be slidably received within the flanged sleeve such that mounting post can rotate relative to the socket. Accordingly, the positionable shelf can rotate relative to the tub body 360 degrees in a horizontal plane.

2 Claims, 2 Drawing Sheets

11
42
30
23
18
26
24
48
16
56
32
40
38
44
46

56
50
32
53
52

PIVOTABLE SHELF FOR A BATHTUB

CROSS-REFERENCE TO RELATED APPLICATION

This application claims the benefit of U.S. Provisional Application No. 61/661,009, filed on Jun. 18, 2012, which is incorporated herein by reference in its entirety.

FIELD OF THE INVENTION

The present invention relates to bathtubs, and in particular, to a pivotable shelf for use with a bathtub.

BACKGROUND OF THE INVENTION

An individual may rest in a bathtub for extended periods of time. During these periods, the individual may desire access to various personal items such as a cellular telephone, book, or beverage. In traditional bathtubs, however, there are limited locations for storing such personal items. Accordingly, individuals are relegated to placing personal items on the surrounding floor areas or locations adjacent the bathtub sidewall. Oftentimes, these locations can be inconvenient and may provide difficulty in accessing personal item when desired.

Some bathtubs have built-in locations for storing personal items. These locations, however, are often inconvenient and fixed such that the personal items can get in the way of the individual's entrance or exit of the bathtub. Moreover, these fixed storage locations oftentimes do not permit easy access to the personal items while an individual is bathing. Accordingly, there is a need for a convenient storage device for storing personal items near the bathtub.

SUMMARY OF THE INVENTION

The present invention is directed to a positionable shelf mounted to a bathtub and a mount therefor integral with the bathtub.

The positionable shelf comprises a substantially planar platform and a mounting post in a corner portion of the platform. A mount for the shelf is provided in an upstanding wall of the bathtub and comprises a socket sized for slidably and pivotably receiving the mounting post. The socket includes a flanged, hollow tubular portion, outwardly threaded and open at both ends, and a flanged sleeve therewithin. The flanged sleeve has an inside diameter sized to slidably and pivotably receive the mounting post of the shelf.

The shelf is adapted to pivot 360 degrees in a horizontal plane relative the bathtub. The shelf may also be displaced along the vertical axis at a desired height by means of a brake and the like frictional engagement between the mounting post and the mount. This allows an individual to change the shelf's position and location for conveniently storing personal items while limiting interference with the individual's enjoyment of the bath.

For example, when entering the bathtub, the individual can pivot the shelf to a position away from the tub thereby facilitating access to the bathtub free from obstruction of the shelf. Once in the bathtub, the individual can pivot the shelf to a closer location so personal items resting on the shelf are conveniently within reach.

DETAILED DESCRIPTION OF PREFERRED EMBODIMENTS

Figure 1:
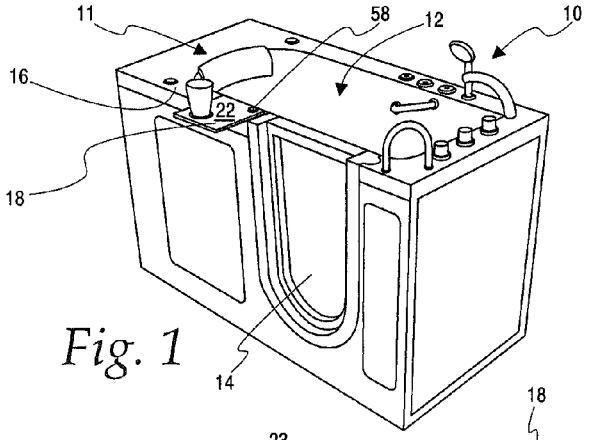
FIG. 1 is a side perspective view of a walk-in bathtub having a pivotable shelf attached thereto.

The invention disclosed herein is, of course, susceptible of embodiment in many forms. Shown in the drawings and described herein below in detail are the preferred embodiments of the invention. It is to be understood, however, that the present disclosure is an exemplification of the principles of the invention and does not limit the invention to the illustrated embodiments.

A bathtub assembly 10, as generally shown in FIG. 1, can include a tub body 11 and a bowl portion 12. The bowl portion 12 may be shaped and sized as generally known in the art to comfortably accommodate an individual. The bathtub assembly 10 can be a walk-in tub that includes a door 14 for facilitating entry and exit. This walk-in access provides safe entry and exit while reducing the need for an individual to dangerously climb over an upstanding sidewall 16 of the bathtub and thereby risk injury. The door 14 can be tightly secured in the closed position so as to sealingly engage the bathtub assembly 10 thereby preventing water from leaking out of the filled bowl portion 12.

Figure 4:
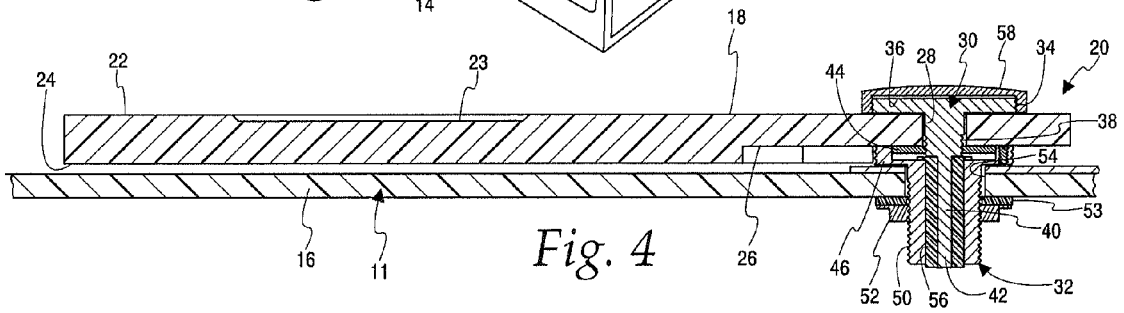
FIG. 4 is a side cross-sectional view of the pivotable shelf attached to the walk-in bathtub by a mount.

As shown in FIGS. 1 and 4, a positionable shelf 18 can be attached to the upstanding sidewall 16 of the tub body 11 by a mount 20. The mount 20 attaches the positionable shelf 18 with the bathtub assembly 10 such that the shelf 18 can swivel 360 degrees in a horizontal plane generally parallel with the tub body 11. Accordingly, the individual can rotate the positionable shelf 18 as desired.

Figures 2, 3:
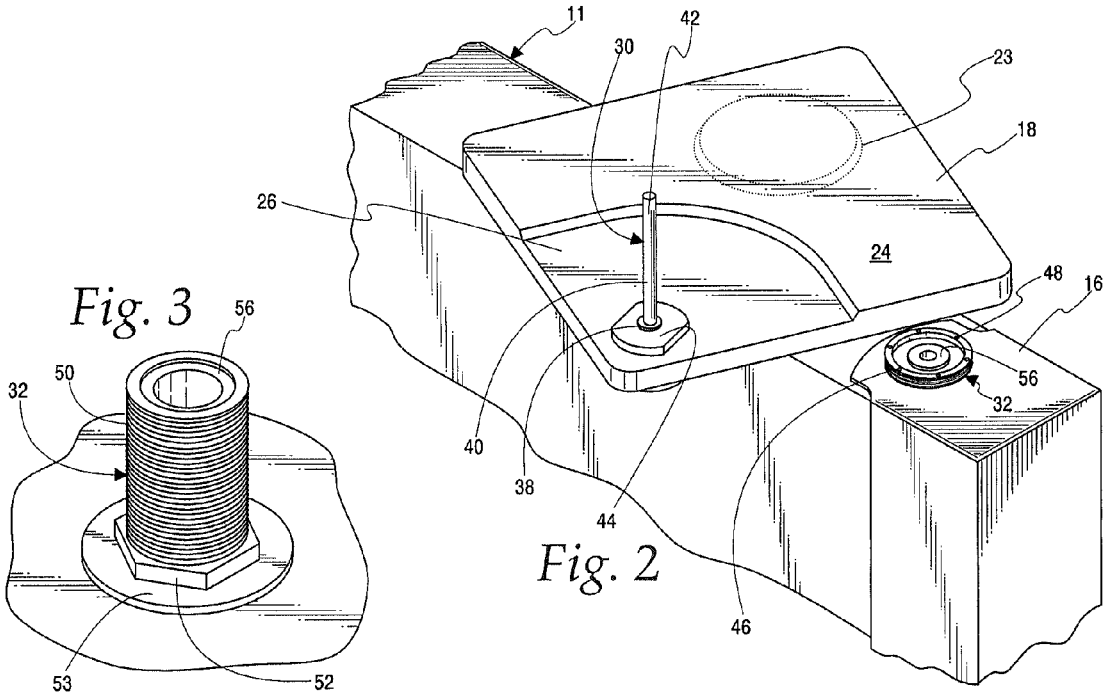
FIG. 2 is a side perspective view of a lower surface of the pivotable shelf having mounting post and a portion of the walk-in bathtub having a socket secured thereto.
FIG. 3 is a perspective view of the socket secured to a portion of the walk-in bathtub.

The positionable shelf 18 includes a generally planar platform having an upper surface 22 and a lower surface 24 as shown in FIGS. 1-2 and 4. The upper surface 22 can have a groove 23 for holding various personal items. In one example, the groove 23 has a generally circular shape and is sized for receiving and holding a beverage container such as a cup or glass. The lower surface 24 includes a swivel cutout 26 for providing clearance as the positionable shelf 18 is rotated. The swivel cutout 26 can limit contact between the positionable shelf 18 and both the mount 20 and the upstanding sidewall 16 thereby permitting smooth horizontal pivoting of the positionable shelf 18. Referring to FIG. 4, the positionable shelf 18 also includes a pivot opening 28 extending through the upper and lower surface 22 and 24 and a generally downwardly extending mounting post 30. The mounting post 30 can be disposed at corner portion of the platform for securing the positionable shelf 18 to the upstanding sidewall 16 of the tub body 11.

As shown in FIG. 4, the mount 20 can include a socket 32 for slidably and pivotably receiving the mounting post 30 in a rotational engagement. Accordingly, the mounting post 30 can be sized to fit within the socket 32 so as to rotate relative to the socket 32. This rotational engagement, therefore, permits rotational movement of the positionable shelf 18 relative to the upstanding sidewall 16 and the tub body 11.

The downwardly extending mounting post 30 includes an upper portion 34 having a generally circular knob 36 and a threaded portion 38. The threaded portion 38 terminates to a lower portion 40 having a generally elongated and cylindrically extending pin portion 42. The downwardly extending mounting post 30 can be securely attached with positionable shelf 18 by insertion of the pin portion 42 through the pivot opening 28. Once inserted, the mounting post 30 can be secured to the shelf 18 by tightening nut 44 about the threaded portion 38. Accordingly, this configuration provides a secured attachment between the positionable shelf 18 and the downwardly extending mounting post 30.

As shown in FIG. 2, the socket 32 includes flanged tubular portion 46 open at both ends and having a plurality of openings 48 for receiving leveling screws. The socket 32 is secured to the upstanding sidewall 16 of the tub body 11 by retaining nut 52. In one example, the plurality of openings 48 may be equally spaced about the circumference of flange 46. Preferably three leveling screws are inserted in the plurality of openings 48 at 120° intervals about the circumference of the annular ring portion 46.

The flanged portion 46 extends downwardly to an outwardly threaded and generally hollow tubular portion 50 having openings as both ends as shown in FIG. 2 and FIG. 4. The upstanding sidewall 16 of the tub body 11 includes an opening 54 for receiving the tubular portion 50. Accordingly, the tubular portion 50 can be inserted through the opening 54 and further secured with the tub body 11 by tightening a retaining nut 52 on the outwardly threaded area of the tubular portion 50. In one example, a washer 53 is provided between retaining nut 52 and the tub body 11.

The hollowed tubular portion 50 is sized for slidably and pivotably receiving the mounting post 30. Preferably a flanged sleeve or liner 56 is inserted within the hollowed tubular portion 50 of the socket 32. In this particular example, the diameter of the flanged sleeve 56 is sized such that the pin portion 42 is slidably and pivotably received within the flanged sleeve 56 thereby permitting the mounting post 30 to rotate relative to the flanged sleeve 56. In this manner, the positionable shelf 18 can pivot relative to the upstanding sidewall 16 and the tub portion 10 thus permitting an individual to rotate the shelf closer, or push it away as desired.

Mount 20 may also permit vertical adjustment of the positionable shelf 18 by providing frictional coaction between pin portion 42 and sleeve 56. Elevation of the positionable shelf 18 can be adjusted by raising or lowering it, and a brake for frictional engagement with pin portion 42 can be provided as part of mount 20, thereby retaining the shelf at a desired elevation.

Referring to FIG. 4, a threaded cap 58 is sized to cover the knob 36 of the mounting post to provide an aesthetically pleasing appearance. The cap 58 is also sized to threadedly engage the upper flange 46. Accordingly, when the mount 20 is dissembled and the positionable shelf 18 and attached mounting post 30 are removed, the cap 58 can be placed over the flanged portion 46 to provide an aesthetically pleasing appearance.

The foregoing description and the accompanying drawings are illustrative of the present invention. Still other variations and arrangements of parts are possible without departing from the spirit and scope of this invention.

I claim:

1. A bathtub assembly, comprising:

a tub body having upstanding wall portions;

a positionable shelf comprising a substantially planar platform and a mounting post in a corner portion of the platform; and a mount for the shelf on an upstanding wall portion of the tub body and defining a socket for the mounting post in said upstanding wall portion, and wherein the mount further comprises a flanged, outwardly threaded, hollow tubular portion open at both ends and a flanged sleeve therewithin.

2. The bathtub assembly of claim 1 wherein the mounting post is slidably and pivotably received within the sleeve.

* * * * *